United States Patent [19]

Hustler

[11] 4,292,376

[45] Sep. 29, 1981

[54] POROUS METAL SHEET LAMINATE

[75] Inventor: David Hustler, Nelson, England

[73] Assignee: Rolls-Royce Limited, London, England

[21] Appl. No.: 84,128

[22] Filed: Oct. 12, 1979

[30] Foreign Application Priority Data

Oct. 28, 1978 [GB] United Kingdom ..... 42364/78

[51] Int. Cl.[3] ..... B32B 15/01

[52] U.S. Cl. ..... 428/593; 428/596; 60/265; 60/754; 60/755; 431/350; 431/352

[58] Field of Search ..... 428/593, 596, 614, 613, 428/597, 600; 431/350–353; 60/750–755, 265, 756; 416/231 R

[56] References Cited

U.S. PATENT DOCUMENTS

| | | | |
|---|---|---|---|
| 3,584,972 | 6/1971 | Bratkovich et al. | 428/596 |
| 3,672,787 | 6/1972 | Thorstenson | 416/231 |
| 3,864,199 | 2/1975 | Meginnis | 416/231 |
| 4,004,056 | 1/1977 | Carvoll | 428/596 |

*Primary Examiner*—Michael L. Lewis

*Attorney, Agent, or Firm*—Cushman, Darby & Cushman

[57] ABSTRACT

A sheet laminate is utilised in the manufacture of a combustion chamber for a gas turbine engine. The laminate has passages therethrough, which connect with ambient atmosphere via holes. The arrangement creates local relatively thick portions or lands which cause stress concentrations along the passages and lines of holes. Therefore pockets are machined in the rear face of each land, so as to reduce the differences in thickness of the laminate and thereby ensure the more even distribution of stresses.

2 Claims, 6 Drawing Figures

POROUS METAL SHEET LAMINATE

This invention relates to porous laminates and a method of manufacturing sheet metal laminate.

In the context of the present invention a porous metal laminate comprises two or more sheets or laminae, each of which has had grooves formed on a face thereof, and holes machined through its thickness at the bottoms of the grooves, the sheets then being permanently joined together, the grooves in one sheet being aligned with respective grooves in the other sheet to form internal channels.

The resulting metal laminate can be used in the construction of e.g. a combustion chamber for a gas turbine engine. In the operating environment of the combustion chamber, hot gases transverse its interior and relatively cold air traverses its outer surface. The combination of holes and grooves in the metal laminate enable the cold air to be drawn into the combustion chamber, under the action of a pressure differential across its wall via a tortuous path, thus cooling the inner surface of the combustion chamber as well as the body of the structure generally.

The production of the grooves in each sheet or lamina, leaves local portions (lands) which are thicker than the remainder of the sheet or lamina. Experiments with the laminate, wherein tensile loads have been applied, in a direction co-planar with the laminate so as to simulate the operating loads which are experienced by a combustion chamber, have shown that the local thick portions prevent distribution of the stresses evenly through the laminate, consequently almost immediately after reaching its elastic limit, the laminate has ruptured either along a groove, or along a line of holes.

The present invention seeks to provide a porous sheet metal laminate having substantially improved elongation. The invention further seeks to provide a method of manufacturing a porous metal laminate as herein defined, such that said improved elongation is achieved.

According to the present invention, there is provided a sheet metal laminate comprising at least two metal sheets or laminae joined by faces, each of which has grooves formed therein and which cooperate to form internal channels, said channels being connected to the laminate outer surface via holes and wherein at least one outer surface of the laminate has pockets therein at positions between the channels so as to substantially reduce the differences in thickness of the laminate. The invention further provides a method of manufacturing porous metal laminate as hereinbefore defined, including the step of machining pockets in that face of at least one sheet opposite to the face of said sheet in which the grooves are formed, so as to reduce the differences in thickness of the metal laminate.

Figure 1:
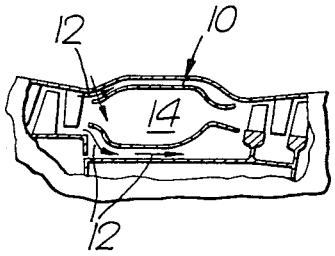
Figure 2:
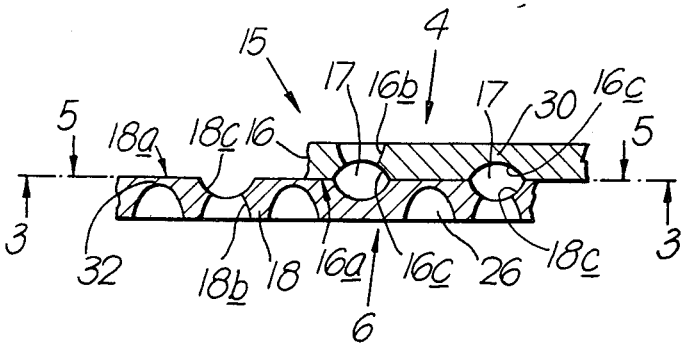
Figure 3:
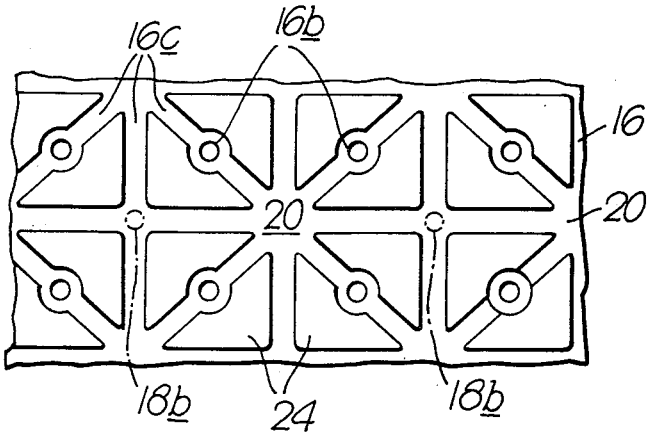
Figure 4:
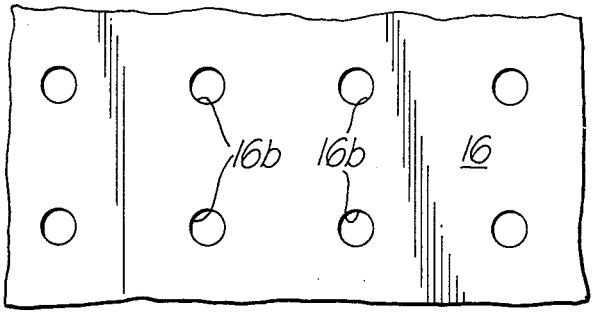
Figure 5:
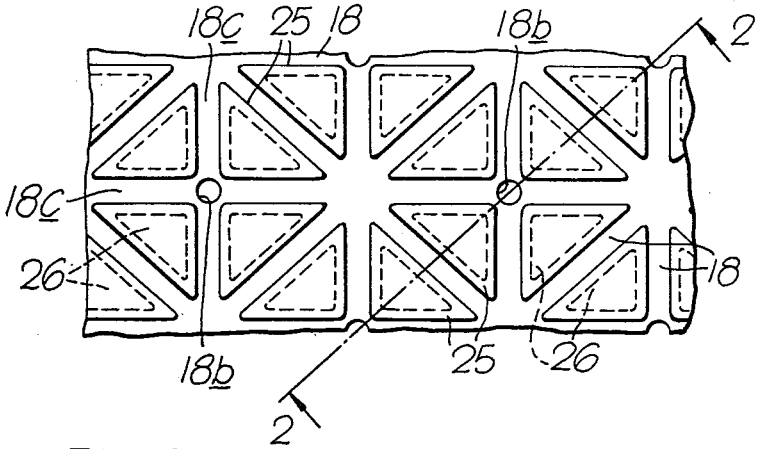
Figure 6:
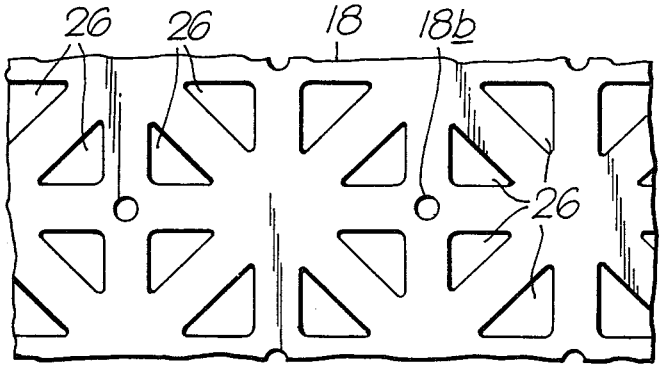

The invention will now be described by way of example and with reference to the accompanying drawings in which:

FIG. 1 is a diagrammatic part view of a gas turbine engine including a combustion chamber of porous metal sheet made in accordance with an embodiment of the invention, FIG. 2 is an enlarged view on line 2—2 of FIG. 5, FIG. 3 is a view on line 3—3 of FIG. 2, FIG. 4 is a view in the direction of arrow 4 in FIG. 2, FIG. 5 is a view on line 5—5 of FIG. 2, FIG. 6 is a view in the direction of arrow 6 in FIG. 2, In FIG. 1 a combustion chamber 10, in operation lies in an ambient airstream as indicated by arrows 12. Simultaneously hot gases are generated in and passed through, the interior 14 of the combustion chamber 10. A difference in velocity between the two fluids exists, resulting in a drop in static pressure across the chamber wall, in an inwards direction. This phenomenum is utilised for the purpose of cooling the chamber wall, by making the chamber wall from porous sheet as herein defined, thus providing tortuous paths for the cooling air to flow through, to the interior of chamber 10.

Referring now to FIG. 2. The porous metal laminate as herein defined, is indicated generally by numeral 15. The laminate 15 in the present example, consists of two sheets or laminae 16, 18 brazed together.

Prior to the brazing operation each sheet or lamina 16, 18 is machined by the electro-chemical/photo resist method, which is well known and per se, is not inventive. The machining operation is such as to form a regular pattern of grooves 16*c*, 18*c*, in those faces 16*a*, 18*a* of the sheets 16, 18 so that on joining of the sheets, the grooves co-operate to form channels 17. Holes 16*b*, 18*b* are also machined in respective sheets 16, 18 and are positioned so as to break into the grooves at specific, regularly arranged locations.

In FIG. 3 it is seen that grooves 16*c* are arranged so as to intersect each other at many regularly spaced positions, over the joining face of sheet 16 and that holes 16*b* break into the grooves 16*c* at regularly spaced positions intermediate those intersections indicated by the numeral 20.

Lands i.e. local portions 24, are formed on the joining face of sheet 16 when grooves 16*c* are machined, whereas only holes 16*b* break the surface of sheet 16 which surface is remote from the joining surface thereof, as shown in FIG. 4.

The identical and complementary patterns of grooves 18*c* which is machined on sheet 18, (FIG. 5) also result in the formation of lands which are indicated by numeral 25. Further holes 18*b* are also machined into sheet 18 in positions at the junction of grooves 18*c* so that on the joining of the sheets 16, 18 the holes 18*b* are arranged alternately relative to junctions 20 in sheet 16, as seen in FIG. 3 where holes 18*b* are superimposed in chain dotted lines.

Referring now to FIG. 6, the surface of sheet 18 which is remote from the surface containing grooves 18*c*, has pockets 26 machined therein. Pockets 26 are each positioned so as to reduce the thickness of respective lands 25 and the relative positions of pockets 26 and lands 25 are shown in FIG. 5 where the pockets 26 are indicated by dotted lines.

In the present example, the lands 25 have their thickness reduced to substantially the extent shown in FIG. 2 i.e. through a substantial portion of the thickness of sheet 18. When sheet 18 is joined to sheet 16, the total thickness of material from the bottom 32 of each pocket 26 through the laminate 15 is nearly equal to the thickness of material between the channels 17 and the pockets sides. This ensures that when tensile stress is applied to the porous sheet 15, as when during the occurrence of expansion of the combustion chamber which is made from the sheets, stress concentrations through the metal surrounding holes 16*b* and 18*b* and grooves 16*c* and 18*c* in the sheets 16 and 18, respectively are much reduced relative to when no pockets 26 have been machined in lands 25. In other words, by providing the blind pockets 26 in the lands 25, the stress concentrations from tensile stresses developed in the laminate 15 are distributed not only through the metal surrounding all of the holes and channels but also through the metal surrounding the pockets so that the stress concentrations through the metal surrounding the holes and channels are reduced, thereby increasing the amount the laminate can be elongated after reaching its elastic limit. Experiment has shown that elongation of the material before fracture can be increased as much as 60% by provision of pockets 26.

In operation of combustion chamber 10, sheet 16 is the outer layer and its outer surface as viewed in FIG. 4 lies in the airstream. It is not desirable to machine pockets in the outer surface of the laminate opposite to the lands 24, or the airflow would become turbulent. However, if the porous laminate can be used in environments not affected by turbulent airflow, pockets 26 may be machined in the outer surface of sheet 16 as well as in the inner surface of sheet 18, but to a reduced depth. The pockets 26 in lands 25 would also be less deep than described hereinbefore.

I claim:

1. A porous sheet metal laminate for use in environments where the sheet metal laminate is subjected to tensile stresses in a direction co-planar with the sheet metal laminate, said sheet metal laminate having outer surfaces and abutting inner faces and comprising at least two metal sheets permanently joined together along the abutting inner faces thereof, each of said abutting inner faces having a pattern of grooves formed therein and cooperating to define internal channels for the laminate, a plurality of holes in each of said sheets extending from the outer surfaces thereof to said internal channels for providing communication between said internal channels and said outer surfaces of the laminate, and a plurality of blind pockets in at least one of said outer surfaces of said laminate, said pockets being positioned in said at least one of said outer surfaces intermediate said channels so that stress concentrations from said tensile stresses in said laminate are evenly distributed through metal surrounding said holes, channels and blind pockets.

2. A porous sheet metal laminate as claimed in claim 1 including a plurality of blind pockets provided in both of said outer surfaces of said laminate, said blind pockets being positioned in said outer surfaces intermediate said channels.

* * * * *